United States Patent [19]

Earls

[11] Patent Number: 4,997,200

[45] Date of Patent: Mar. 5, 1991

[54] COMBINATION WHEELCHAIR-GURNEY APPARATUS

[76] Inventor: Richard J. Earls, 2 Fayson Lakes Rd., Kinnelon, N.J. 07405

[21] Appl. No.: 492,132

[22] Filed: Mar. 13, 1990

[51] Int. Cl.[5] ..... A47C 13/00

[52] U.S. Cl. ..... 280/648; 5/81 R; 280/304; 280/304.1; 297/DIG. 4

[58] Field of Search ..... 5/60, 66, 81 R, 81 B; 297/34, DIG. 4; 280/250.1, 300, 304, 304.1, 647, 648, 650, 47.33, 755, 763.1

[56] References Cited

U.S. PATENT DOCUMENTS

| | | | |
|---|---|---|---|
| 2,402,322 | 6/1946 | Flynn, Jr. | 280/755 |
| 2,587,068 | 2/1952 | Sanders | 5/81 B |
| 3,038,174 | 6/1962 | Brown et al. | 5/68 X |
| 4,153,268 | 5/1979 | Wilson et al. | 280/304 X |
| 4,285,541 | 8/1981 | Onishi | 5/81 R X |
| 4,453,732 | 6/1984 | Assanah et al. | 5/68 X |
| 4,565,385 | 1/1986 | Morford | 280/304.1 |
| 4,717,169 | 1/1988 | Shaffer | 5/68 X |
| 4,787,104 | 11/1988 | Grantham | 5/66 |
| 4,821,352 | 4/1989 | DiMatteo et al. | 5/81 R |

*Primary Examiner*—Charles A. Marmor
*Assistant Examiner*—Michael Mar
*Attorney, Agent, or Firm*—H. Jay Spiegel

[57] ABSTRACT

The present invention relates to an improved combination wheelchair-gurney apparatus. The improved wheelchair-gurney includes a pivoting back rest and foot rest which permit the wheelchair to be transformed into a gurney and vice versa. The combination wheelchair-gurney also includes transferring means associated with the foot rests, seat rest, and back rest which facilitate transferring a patient from the apparatus when in the gurney position to an adjacent bed or examining table. Furthermore, an additional wheel assembly is included which may provide support for the back rest when the apparatus is in the gurney position.

6 Claims, 8 Drawing Sheets

COMBINATION WHEELCHAIR-GURNEY APPARATUS

BACKGROUND OF THE INVENTION

The present invention relates to an improved combination wheelchair-gurney apparatus that is designed to convert from a wheelchair configuration into a gurney and also assists transferring a patient in the wheelchair-gurney apparatus to a bed or other horizontal surface. In the prior art, convertible bed and wheelchair devices as well as other invalid transferring arrangements are known. However, none of the prior art teaches or fairly suggests all of the features of the present invention including a wheelchair that may convert into a gurney and transfer a patient from the gurney to a bed or other horizontal surface. The following prior art is known to Applicant:

U.S. Pat. No. 4,717,169 to Shaffer discloses the concept of a wheeled structure that is readily convertible between a full-sized bed and a wheelchair. This is different from the teachings of the present invention in that the unit as described by the Shaffer patent does not include mechanism to facilitate transferring the patient from the bed arrangement onto another like bed.

U.S. Pat. No. 4,787,104 to Grantham discloses the concept of a convertible hospital bed that includes mechanism to assist moving a patient that is in the bed into a sitting position and off the bed. The teachings of the Grantham patent are only generally related to the present invention and fail to include a wheelchair unit that is convertible into a gurney.

U.S. Pat. No. 4,821,352 to DiMatteo et al. discloses an arrangement combining a wheelchair with a bed, wherein the bed has mechanism that assists an invalid from the bed into a wheelchair with the wheelchair having mechanism to receive the invalid from the bed. The wheelchair unit of DiMatteo et al. is different from that of the present invention as failing to include structure which permits transfer of an invalid between a bed and a convertible wheelchair where the convertible wheelchair is located adjacent the side of the bed.

SUMMARY OF THE INVENTION

The present invention relates to an improved combination wheelchair-gurney apparatus. The present invention includes the following interrelated aspects and features:

(A) In the first aspect, the combination wheelchair-gurney apparatus is seen to include a frame, a pair of swivellable front wheels, a pair of rear wheels, a pivotable pair of foot rests, a pair of removable arm rests, a movable seat rest and a pivotable back rest.

(B) The pivotable foot rests and back rest permit the apparatus to be transformed between a wheelchair and a gurney. In the gurney position, the foot rests are raised and the back rest is reclined so that a patient may lie in a horizontal position during transport or transfer.

(C) The combination wheelchair-gurney also includes an additional wheel assembly that may be utilized in the gurney position. The wheel assembly includes a pair of wheels that may be swivellably retracted from a hollow frame member and used to support the back rest in the reclined position and assist in movement of the gurney.

(D) The improved wheelchair-gurney may also include transferring means to assist moving a patient from the wheelchair to an adjacent horizontal surface such as a bed. This transferring means includes means situated beneath the foot rests, seat rest and back rest. The transferring means are adapted to span the gap between the wheelchair-gurney and an adjacent surface so that the patient may be easily transferred between the surface and the combination wheelchair-gurney. The combination wheelchair-gurney also includes features to raise the seat rest so that the rear wheel of the wheelchair does not interfere with the transferring procedure.

(E) The apparatus may also include a securing device which assists in stabilizing the wheelchair to a bed or wall during the transfer process so that only one individual may be required to transfer a patient.

Accordingly, it is a first object of the present invention to provide an improved combination wheelchair-gurney.

It is a further object of the present invention to provide an apparatus that may convert between a wheelchair and a gurney.

It is a yet further object of the present invention to provide an apparatus that contains features that permit a patient to be easily transferred from the combined wheelchair-gurney apparatus to an adjacent bed or the like.

These and other objects, aspects and features of the present invention will be better understood from the following detailed description of the preferred embodiment when read in conjunction with the appended drawing figures.

SPECIFIC DESCRIPTION OF THE PREFERRED EMBODIMENTS

Figure 1:
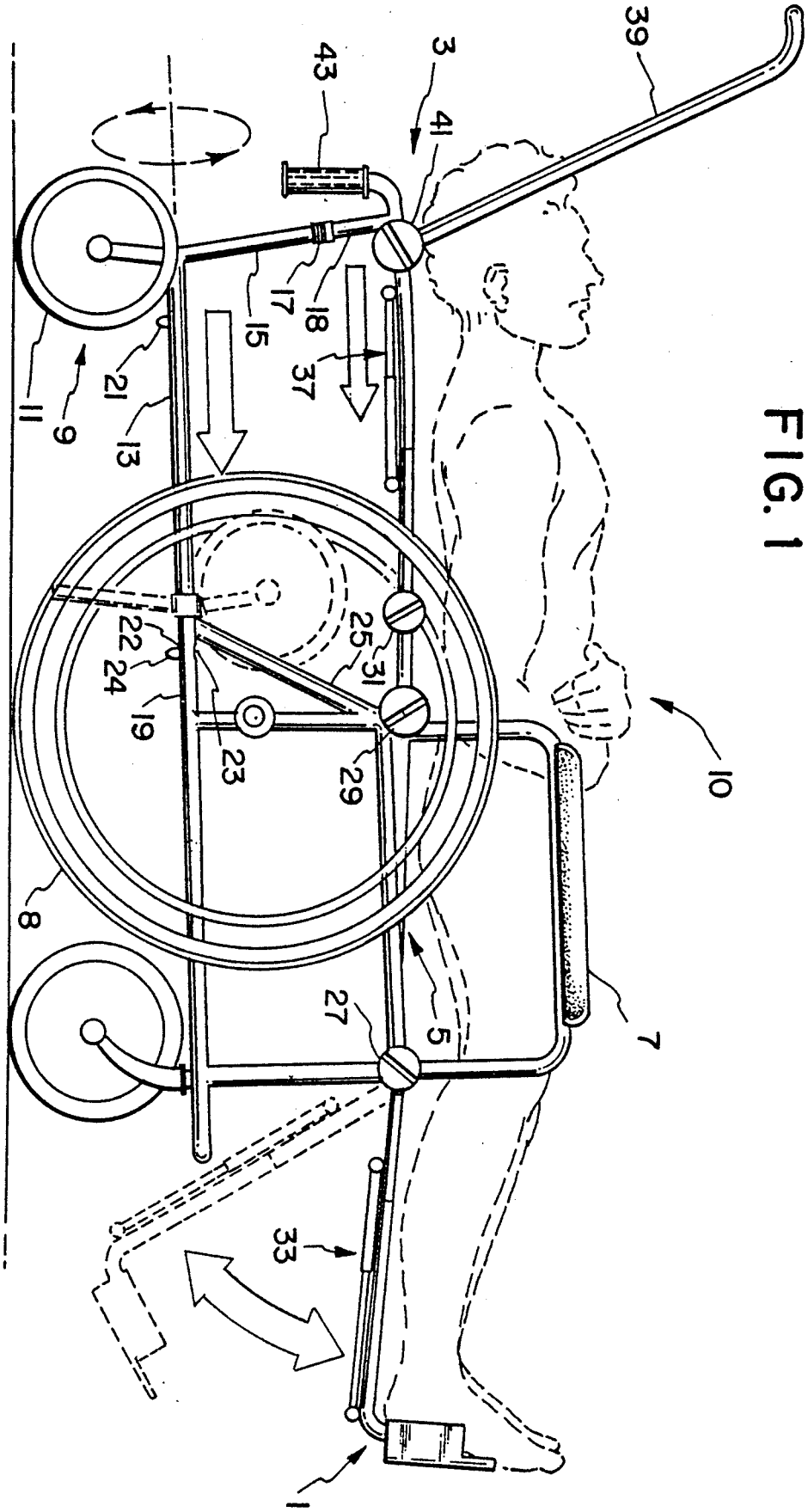
FIG. 1 shows an elevational view of the combination wheelchair-gurney in the gurney position.

With reference to FIG. 1 firstly, the improved combination wheelchair-gurney apparatus is generally designated by the reference numeral 10 and is seen to include a foot rest 1, a back rest 3, a seat rest 5 and an arm section 7. The arm section 7 is of the design that may be easily removed from the wheelchair. These types of removable arm rests are well known in the art and are not intended to be an aspect of the present invention. It should be understood by those skilled in the art, any known type of removable arm sections may be employed in the inventive apparatus. The removable arm feature is included as an aspect of the wheelchair to facilitate transferring of a patient from the wheelchair-gurney to a bed as will be described hereinafter. Alternatively, a hinged arm rest, also known in the art, may be utilized that would fold down rather than be removable.

In one aspect of the invention, an additional wheel assembly designated by the reference numeral 9 is illustrated in FIG. 1. The wheel assembly 9 is seen to include a wheel 11, a stabilizing bar 15 and a member 13. The wheel assembly 9 is designed such that the member 13 may slide within the hollow frame member 19 as well as rotate 180 degrees. The member 13 includes two spring loaded pins, 21 and 24, which are adapted to engage the openings 22 and 23 in the hollow frame member 19. In the gurney position, the wheel assembly 9 is extended out from the frame member 19, the pin 24 locking the assembly in place by extending through the opening 22. Additionally, a coupling means 17 connects the stabilizing bar 15 to the back rest 13 by means of the leg 18. Any known type coupling means may be utilized for the depicted coupling means 17 such as a screw type which may screw onto a threaded end of the stabilizing bar 15 and freely rotate about the member 18. The leg 18, coupling 17 and the stabilizing bar 15 operate to support the back rest when in the reclined position.

When the wheel assembly 9 is not being used, the member 13 may be rotated 180 degrees and slid back into the hollow frame member 19, this configuration being depicted in phantom in FIG. 1. In this position, the spring loaded pin 21 would occupy the opening 23 in the frame member 19, thus securing the wheel assembly when not in use. Alternatively, the wheel assembly 9 may be rotated 180 degrees from the configuration shown in phantom in FIG. 1, such that the wheel 11 may be in contact with a floor surface and spring loaded pin 24 occupies the opening 23 to lock the assembly in this position. In this mode, the wheel assembly may provide additional support in the wheelchair position.

The back rest 3 is seen to include two pivoting points designated by the reference numerals 29 and 31. In the gurney position, the back rest 3 pivots at the pivot point 29 such that the patient lies in a horizontal plane. Also included as components of the back rest 3 are the handle 43 used for pushing the apparatus when in the wheelchair position and a handle 39 which may assist in pushing the apparatus in the gurney position. The handle 39 is removably attached to the back rest by locking bolt 41.

With reference to FIG. 1 again, the foot rest 1 and the back rest 3 are shown with the transferring means 31 and 33, respectively. As will be described hereinafter, the transferring means assist transferring a patient from the apparatus to an adjacent horizontal surface such as a hospital bed or examining table. The foot rest 1 also includes a pivoting means 27 which permits the foot rest to be raised or lowered as shown by the arrow and the phantom configuration in FIG. 1.

The apparatus may also include a brace 25 integral with the wheelchair frame to provide additional structural support for the additional wheel assembly 9.

Figure 2:
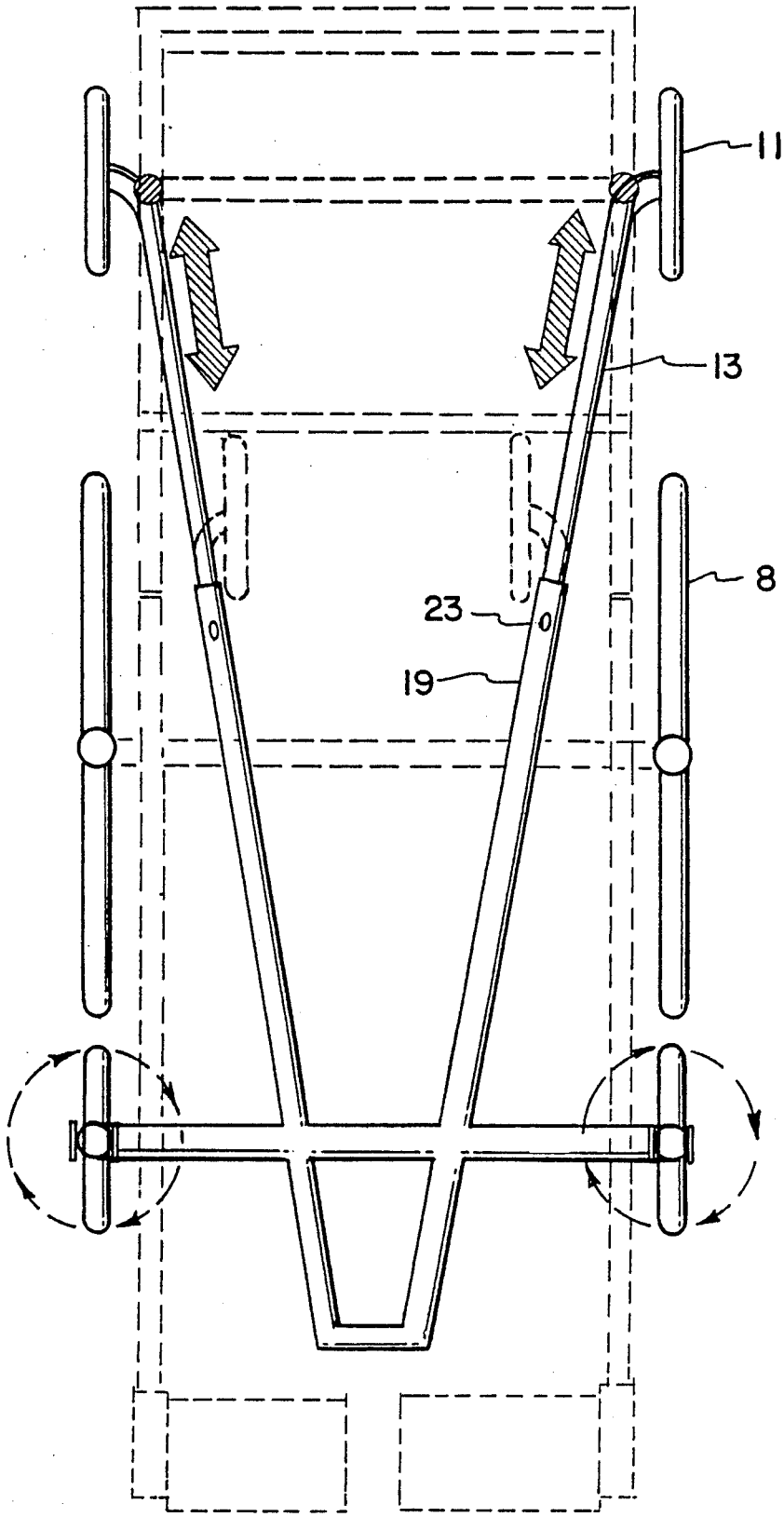
FIG. 2 shows a plan view of the wheel assembly of the combination wheelchair-gurney.

FIG. 2 shows a plan view of the wheel assembly 9 and more clearly depicts the configuration of the wheel 11, the member 13 and the frame 19. When in use, the wheel assembly 9 is rotated such that the wheels 11 are aligned with the wheels 8. When not in use, the wheels 11 are turned inward as shown in phantom so that as not to interfere with the wheelchair itself or a person pushing it.

With reference to FIGS. 3, 4, 6, 10 and 11, the transferring means 33, 35 and 37, used to transfer a patient from the gurney position to a bed are illustrated. With reference to the transferring structure 37 for the back rest 3 and FIGS. 3 and 6, the transferring structure 37 is seen to include a pair of hollow, tubular members 83 and 85, member 83 being attached to the member 59 and the member 85 being attached to the member 57. In combination with the members 83 and 85 is a plate 52 having tubes **88*a* and 88*b* connected at either end, the tubes 88*a* and 88*b* being adapted to slide in and out of the members 83 and 85, respectively. This telescoping feature permits the plate 52 to be slid out from an adjacent relation to back rest 3 and permits a patient to be transferred to an adjacent horizontal surface. The back rest portion also includes a telescoping feature for plate 87 as well as means to permit the transferring means 37 to travel along the length of the back rest portion 3**, both of which will be described hereinafter.

Figure 3:
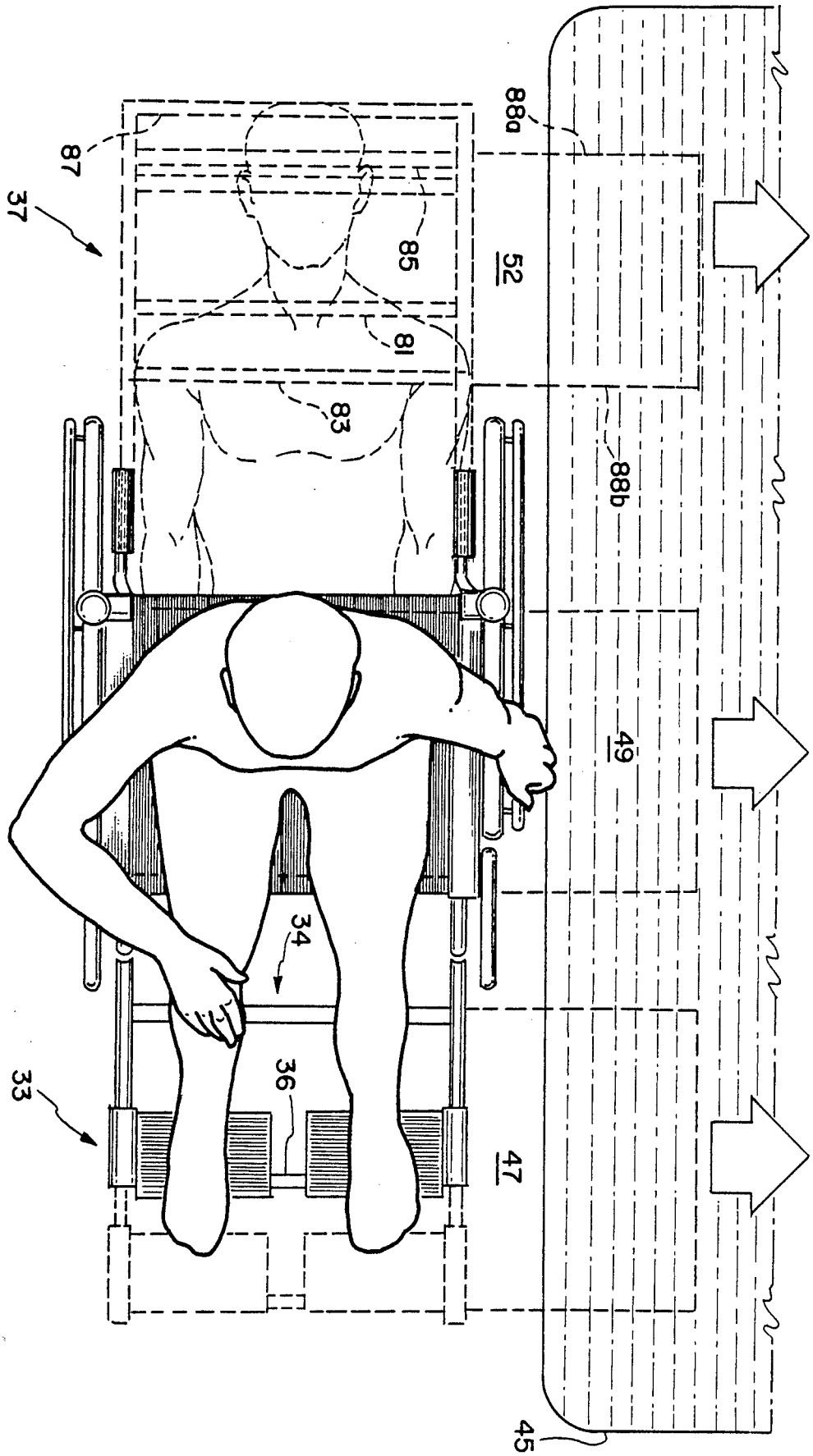
FIG. 3 shows a plan view of the apparatus in an exemplary transferring position.

With reference to FIG. 1 again and FIG. 3, the transferring structure 33, similar in design to the transferring structure 37 is seen to be attached to the foot rest 1 and operates in a similar manner as that described above for the back rest 3. Specifically, the plate 47 slides out of the members 34 and 36 so as to span the gap between the foot rest 1 and the bed 45. The transferring structures 33 and 37 may be locked in place by a spring loaded locking pin arrangement as described for the wheel assembly 9. Of course, other locking means as well as other mechanisms for extending the plates 47 and 52, such as a swinging hinge arrangement may be utilized in place of the sliding mechanism described.

FIG. 3 also shows a transferring means 49 which is adapted to span the gap between the seat rest 5 and the bed 45. This transferring means, as will be described hereinafter, is designed to avoid the wheel 8 so as to permit the transfer of a patient while in the combination wheelchair-gurney. As will also be described hereinafter, the transferring means 49 may be replaced with two transferring means, one attached to the back rest portion and one similar to transferring means 49 but smaller in size.

Figure 4:
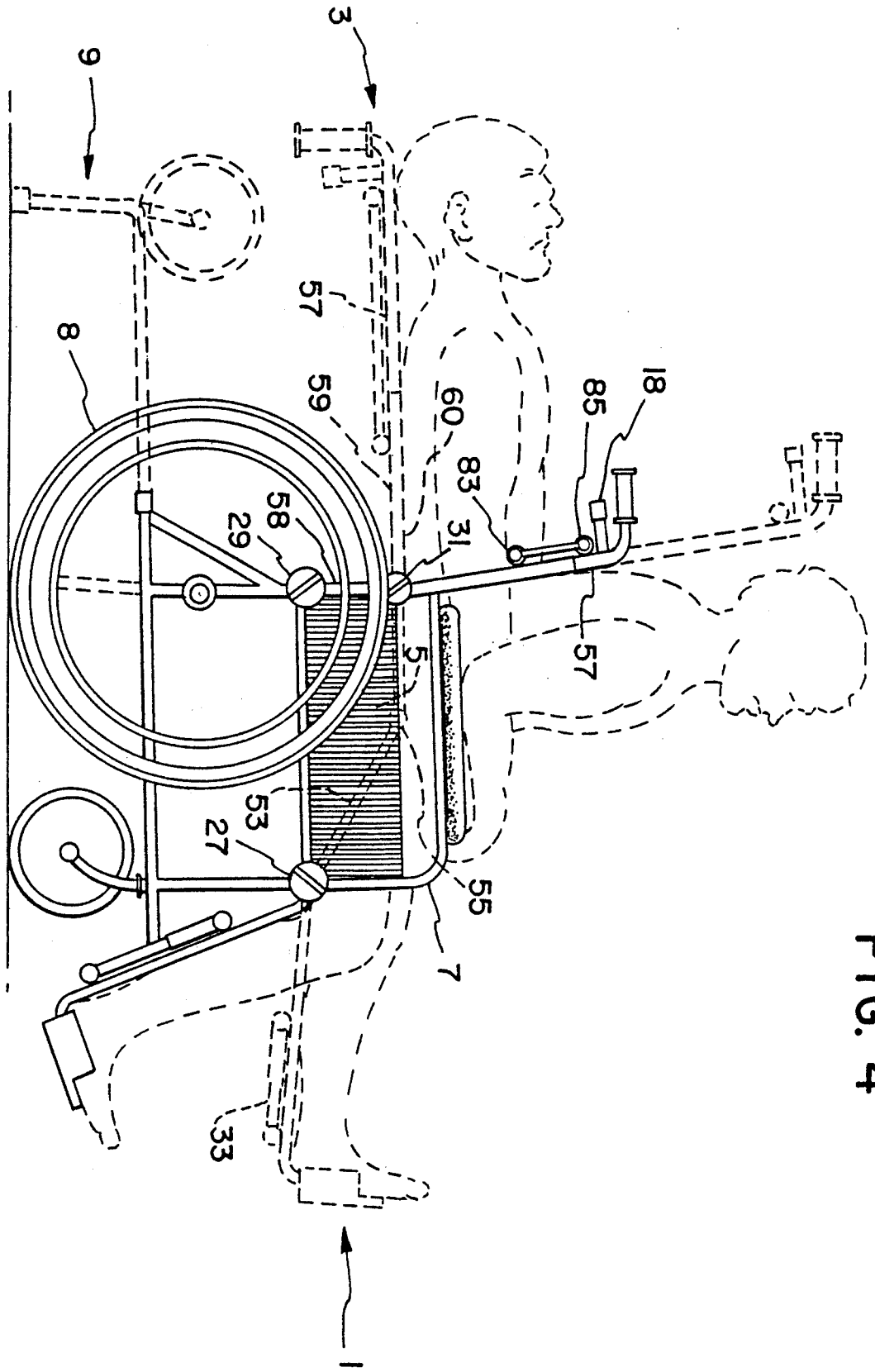
FIG. 4 shows an elevational view of the apparatus in an exemplary transferring position.
Figure 5:
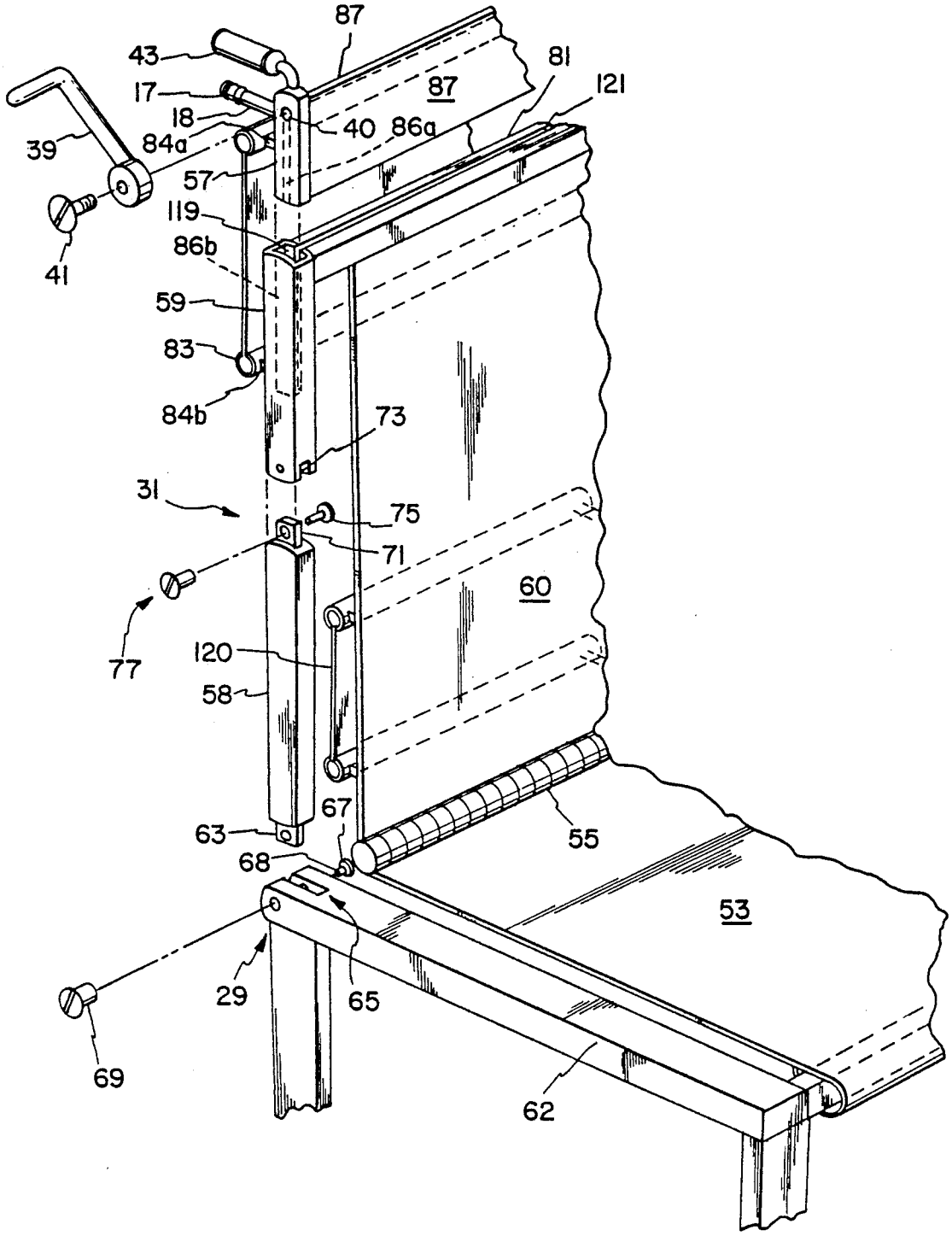
FIG. 5 shows an exemplary seat rest raising mechanism in greater detail.

FIGS. 4 and 5 more clearly show the relative position of the back rest 3 and the seat rest 5 when transferring a patient to a bed. The back rest 3 pivots at the pivot point 31, thereby permitting the back rest 3 to recline to a horizontal position. The back rest 3 includes a rigid plate 60 which is attached at one end to the cross bar 81 which separates the member 59 from the corresponding member on the other side of the wheelchair (not shown). The other end of the rigid plate 60 is attached to the piano hinge 55, thereby connecting the back rest to the seat rest. The back rest 3 should have sufficient rigidity such that the pivoting action at the pivot point 31 raises the hinge 55 in an orientation above the wheelchair as shown in phantom in FIG. 4. The rigid plate 60 may have a cushion or the like thereon to provide comfort to a patient while in the wheelchair-gurney apparatus. Alternatively, although not depicted, the rigid plate 60 may be replaced with a combination of a rigid frame corresponding to the peripheral dimensions of the rigid plate 60 with a fabric back rest support such that the combination frame and fabric attached thereto would pivot about pivot point 31. The pivot point 31 is shown in greater detail in FIG. 5 and is seen to include a slot 73 in the member 59 being adapted to receive a stem 71 of the member 58. A pin 75 joins the members 59 and 58 and is secured by a locking nut 77.

With reference to FIGS. 5, 6, 10 and 11, the telescoping features of the back rest will be described in greater detail. Prior to reclining the back rest 3, the telescoping member 57 and plate 87 may be withdrawn from the member 59 so that a patient will be fully supported when the back rest 3 is in the reclined position by plate 87. In operation, member 57 and the corresponding member on the opposite side of the apparatus and plate 87 telescope within the openings 119 and 121 in members 59 and 81, respectively. In this manner, when the back rest is in the configuration as depicted in FIG. 4, a patient is supported along their back by the extended plate 87 and plate 60. Additionally, the telescoping feature permits the back rest to be easily adapted to patients of differing heights. This telescoping feature may also include locking means (not shown) similar to the locking pin arrangement as described for the wheel assembly 9. Of course, other locking means to secure the telescoping member 57 and plate 87 in a particular orientation may be used. The wheel assembly 9 may also be withdrawn to provide additional support in this configuration.

Figure 6:
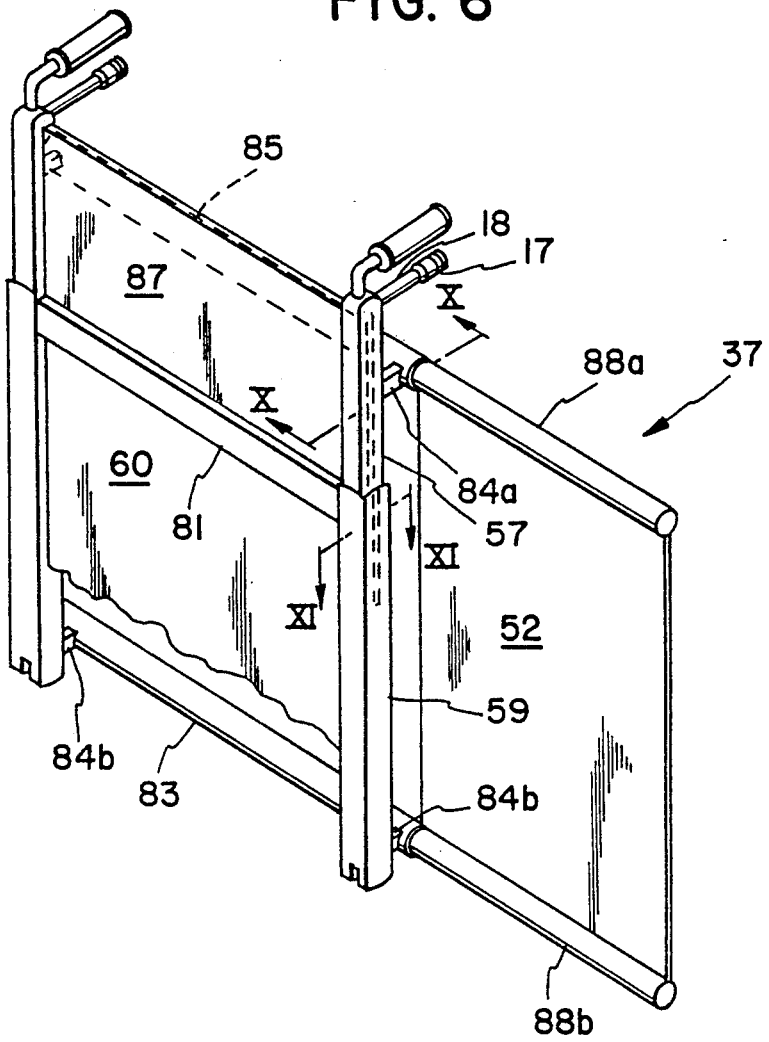
FIG. 6 shows a typical transferring means for the present invention.
Figure 10:
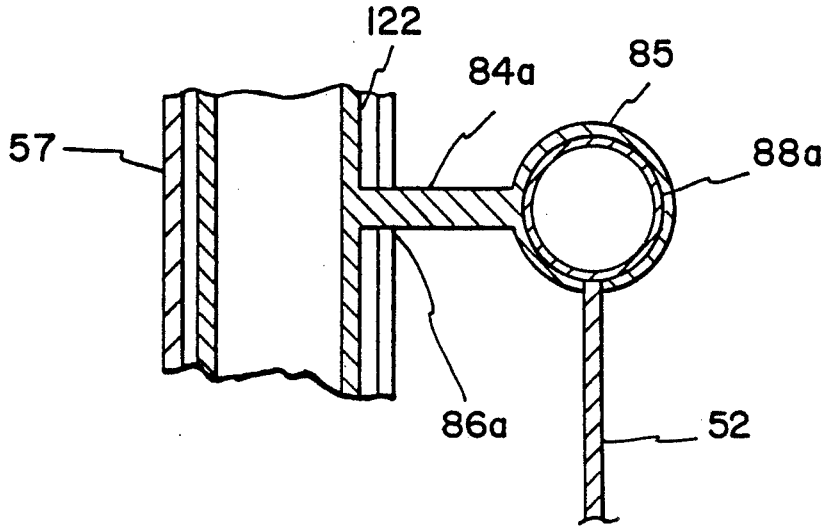
FIG. 10 shows a cross-sectional view along the line X—X of FIG. 6.
Figure 11:
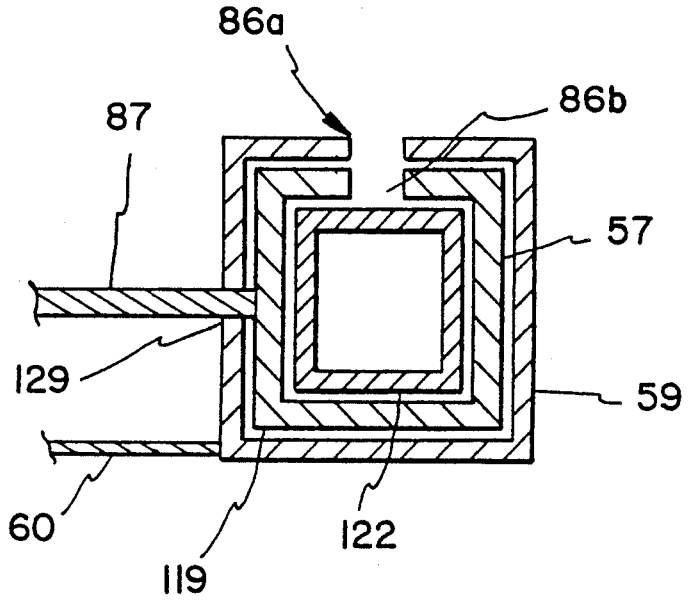
FIG. 11 shows a cross-sectional view along the line XI—XI of FIG. 6.

With particular reference to FIGS. 10 and 11, FIG. 10 shows a cross-sectional view along the line X—X of FIG. 6. As can be seen from the drawing, the plate 52 has a rounded end portion 88 which is adapted to fit within hollow member 85, thereby permitting the plate 52 to telescope out from beneath the back rest and assist transferring a patient to a bed. The hollow member 85 includes a leg **84*a* terminating at a member 122, the member 122 also being connected to leg 84*b* of member 83. The legs 84*a* and 84*b* are adapted to rest in the channel 86*a* and 86*b*, respectively, in the members 59 and 57, respectively, so as to permit the transferring means 37 to travel along the length of the back portion 3**.

With reference back to FIG. 5 and FIGS. 10 and 11, the member 59 includes a channel **86*a* which is aligned with the channel 86*b* of member 57 such that the transferring means 37 by means of legs 84*a* and 84*b* and member 122, the member connected between legs 84*a* and 84*b*, travel along the aligned channels 86*a* and 86*b* thereby permitting the plate 52 to travel along the back portion 3**.

In addition, FIG. 11 shows the plate 87 in sliding engagement in the channel opening 129 in member 59 thereby permitting plate 87 to telescope in relation to plate 60.

Prior to describing the operation of pivoting the back rest at point 31 so as to transfer a patient above the wheel 8 of the wheelchair, the details of the pivot point 29 will be now explained. The pivot point 29 is seen to include a stem 63 protruding from the member 58, which occupies the slot 65 in the frame member 62. A pin 67 having a threaded end 68 slides through the aligned openings in the frame member 62, stem 63, the pin being secured by a locking nut 69. Although not depicted, a corresponding set of components exists for the pivot points 29 and 31 on the opposite side of the wheelchair. Selective loosening of the locking nuts 69 and 77 will permit pivoting at the pivot points 29 or 31.

In operation, in the wheelchair position, the locking nut 69 locks the pivot point 29 such that the back rest 3 is aligned 90 degrees with respect to the seat 53. In the transfer position, as shown in FIG. 4, the back rest 3 is pivoted at point 31 so as to raise the seat sections 53 and 60 to extend above the height of the wheel 8, see FIG. 4. This pivoting action raises the seat of a patient over the wheelchair wheel and permits the patient to be slid off the apparatus onto an adjacent bed or the like.

Figure 7:
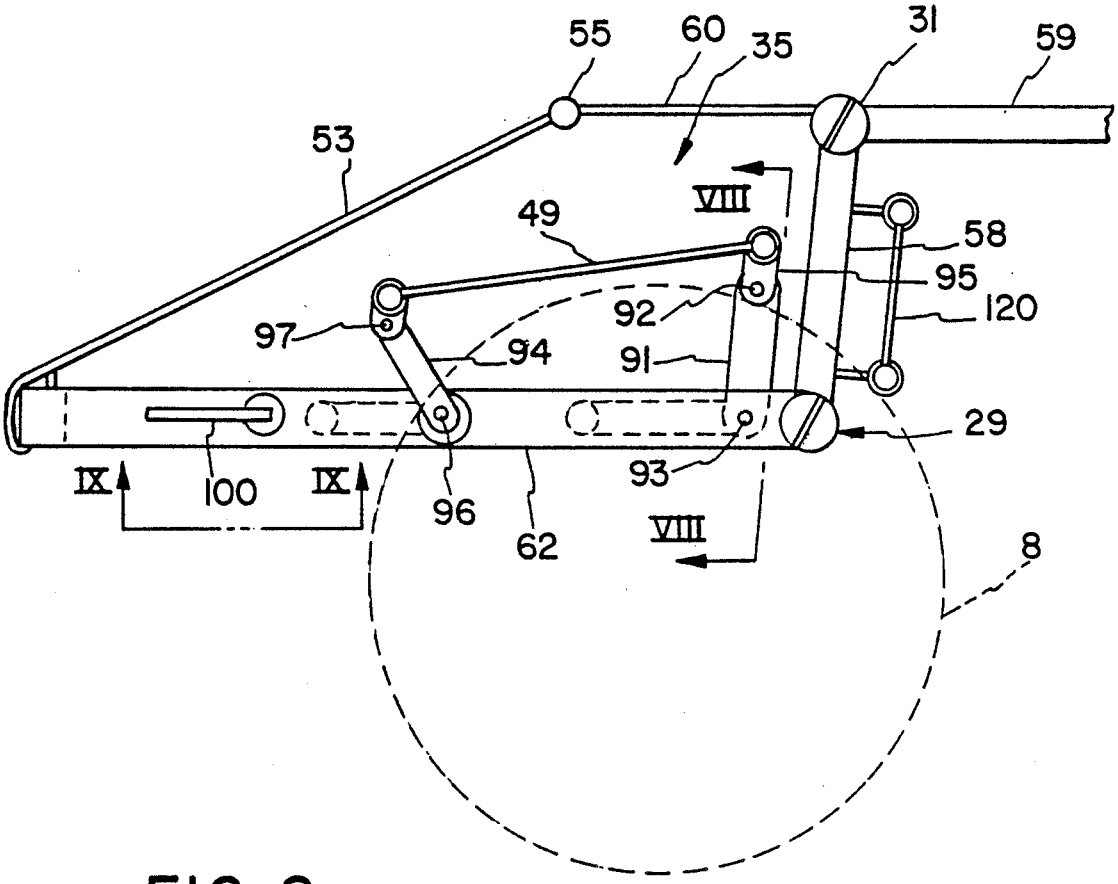
FIG. 7 shows an elevational view of an exemplary pivoting seat rest transferring means.
Figure 8:
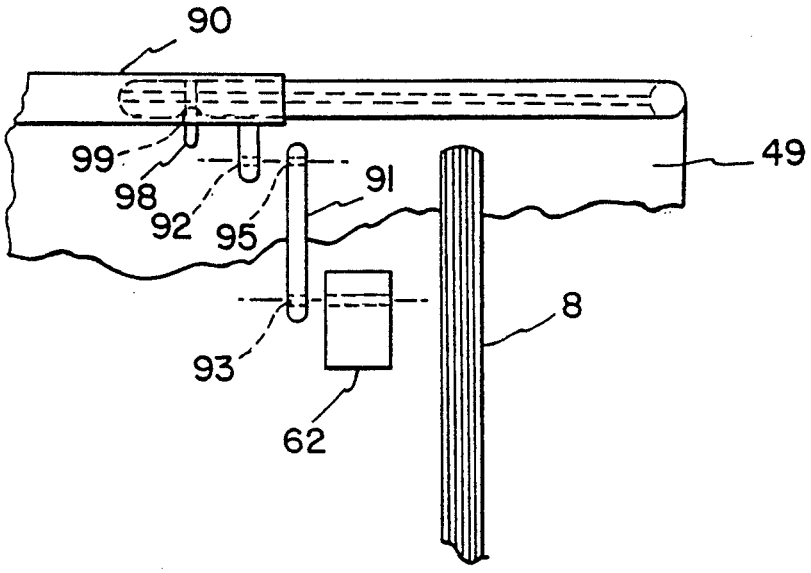
FIG. 8 shows a cross-sectional view along the line VIII—VIII of FIG. 7.

FIGS. 7 and 8 illustrate an exemplary transfer mechanism 35 provided below the seat 53 of the wheelchair. A similar sliding means 49 to the mechanism shown in FIG. 6, slides in and out of the tube 90 and is lockable in the extended position by a spring loaded pin 98 extending through the opening 99 in the tube 90. The sliding member 49 is pivotally connected to the frame member 62 by a leg 95 attached to the tube 90, the leg 95 pivotally connected at the reference numeral 92 to a connecting arm 91, the connecting arm 91 pivotally connected at the reference numeral 93 to the frame member 62. A similar arrangement for the other end of the sliding means 49 includes a leg 97 connected to the tube 90 and pivotally connected to the frame member 62 at reference numeral 96 by the connecting arm 94. It should be understood that a similar pivoting assembly exists on the other side of the wheelchair to provide the proper structural support for the transferring mechanism.

In operation, once the seat 53 is raised sufficiently above the wheel 8 by the pivoting action of the back rest 3 at the pivot point 31, the transferring assembly 35 is pivotally raised such that the sliding means 49 may be withdrawn from the tubular member 90 and span the gap between a bed and the combination wheelchair-gurney. The transferring assembly 35 should also include a locking means to secure the means 49 in the raised position. This locking means (not shown) may include protrusions on the connecting arms 91 and 94 which would lock into an aligned recess opening in the legs 95 and 97 to lock the transferring mechanism in the raised position. Of course, any known type locking means may be utilized to secure the transferring mechanism in the raised position.

It should also be understood that other designs may be utilized to raise the seat portion over the wheel and provide a transferring mechanism that may span the gap between the combination wheelchair-gurney and an adjacent surface. With reference back to FIG. 5, an additional transferring means designated by the reference numeral 120 may be included and attached to the plate 60. This transferring means would be the same design as that shown in FIG. 6 and would be adapted to provide support for a patient during transfer to a bed between the pivot points 29 and 31. If this additional transferring means is utilized, the transferring means 49 as shown in FIG. 7 would be shifted towards the front of the wheelchair-gurney apparatus such that two transferring means 49 and 120 would assist moving a patient from the seat portion 5.

Figure 9:
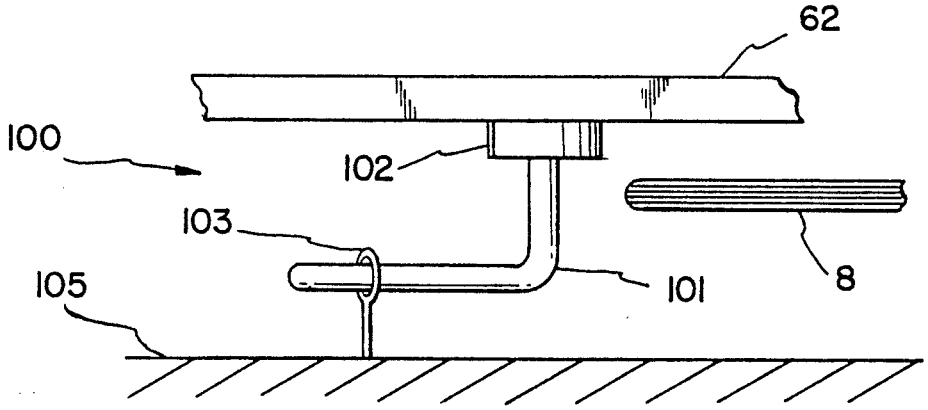
FIG. 9 shows the locking bar of the apparatus in greater detail.

With reference to FIGS. 7 and 9, a locking bar 100 is shown attached to the frame member 62. This locking bar is designed to secure the wheelchair during transferring a patient by insertion of the locking bar leg 101 into an eye bolt 103 that is attached to a surface 105 such as a wall, bed or other adjacent device. The locking bar leg 101 may be attached to the frame by a spring loaded hinge 102 which permits rotation and locking of the bar 101 in a particular orientation. Of course, other types of attachment means between the locking bar 100 and the frame member 62 may be utilized. The wheelchair may have a locking bar on the frame portion 62 and an additional locking bar in an opposite direction on another portion of the wheelchair, such as the back rest 3. When the back rest 3 is in the reclined position, the wheelchair may be hooked to a wall by insertion of a first locking bar into an eye bolt. After the first locking bar is inserted, the wheelchair may be backed up such that a second locking bar, the locking bar leg facing the opposite direction of the first locking bar leg is inserted into a corresponding aligned second eye bolt. Thusly, the locking bars permit the wheelchair to be secured in place during transfer of a patient.

The improved wheelchair-gurney of the present invention offers many advantages over those of the prior art. The inventive apparatus includes features that permit a patient to use the apparatus as a wheelchair or as a gurney. Additionally, the inventive apparatus includes features that permit a patient to be easily transferred from the apparatus to an adjacent horizontal surface.

As such, an invention has been disclosed in terms of a preferred embodiment thereof which fulfills each and every one of the objects of the invention as set forth hereinabove and provides a new and improved combination wheelchair-gurney of great novelty and utility.

Of course, various changes, modifications and alterations in the teachings of the present invention may be contemplated by those skilled in the art without departing from the intended spirit and scope thereof. As such, it is intended that the present invention only be limited by the terms of the appended claims.

What is claimed is:

1. An improved combination wheelchair-gurney apparatus comprising:

(a) a wheelchair frame having attached thereto a pair of swivellable front wheels, a pair of rear wheels and a pair of removable arm rests;

(b) a pair of foot rests, each said foot rest being pivotally connectable to said wheelchair frame;

(c) a back rest being pivotally connectable to said wheelchair frame at a first pivot point;

(d) a seat rest being hinged to a portion of said back rest; and (e) a wheel assembly being slidably connectable to said wheelchair frame and being adapted to support said back rest, said wheel assembly including a pair of elongated members which are extendible within said frame, a wheel rotatably attached to an outer end of each said elongated member, and a stabilizing bar attached to each said elongated member adjacent its outer end and extending angularly therefrom;

(f) whereby, said back rest and each respective said foot rest may be pivotally moved such that said back rest, each said foot rest and said seat rest lie in a horizontal plane thereby forming a gurney and said wheel assembly may be extended from said wheelchair frame to support said back rest and facilitate movement of said apparatus.

2. The invention of claim 1, wherein each of said back rest, said wheelchair frame and said pair of foot rests includes means attached thereto for transferring a patient on said apparatus from said apparatus to an adjacent horizontal surface, each said means being capable of spanning between each of said back rest, said wheelchair frame, and said foot rest and an adjacent structure.

3. The invention of claim 1, wherein said back rest includes means to pivotally recline said back rest at a second pivot point and raise said seat rest above a said rear wheel.

4. The invention of claim 1, further including means for securing said apparatus to an adjacent structure to permit easy transfer of a patient from said apparatus to an adjacent structure.

5. The invention of claim 1, wherein said back rest further comprises a telescoping plate assembly, said telescoping plate assembly being adapted to provide additional horizontal support for a patient.

6. The invention of claim 2, further including at least two said means attached to said back rest for transferring a patient from said apparatus to said adjacent horizontal surface.

* * * * *